United States Patent [19]

Camp et al.

[11] 4,333,417

[45] Jun. 8, 1982

[54] COATING SYSTEM

[76] Inventors: Neal H. Camp, 107 Wood St., Willits, Calif. 95490; James E. Paetz, 5061 Pressley Rd., Santa Rosa, Calif. 95404; Nicholas L. Patterson, 24033 Sherwood Rd., Willits, Calif. 95490

[21] Appl. No.: 103,101

[22] Filed: Dec. 13, 1979

[51] Int. Cl.[3] ..... B05C 3/10; B05C 11/06

[52] U.S. Cl. ..... 118/50; 118/63; 118/405; 118/406; 118/DIG. 9

[58] Field of Search ..... 118/404, 405, 406, 50, 118/63, 65, DIG. 9, 429

[56] References Cited

U.S. PATENT DOCUMENTS

| | | | |
|---|---|---|---|
| 1,230,151 | 6/1917 | Guichard | 118/405 X |
| 1,727,929 | 9/1929 | Berssenbrugge | 118/DIG. 9 |
| 1,893,937 | 1/1933 | Gardiner | 118/405 X |
| 2,717,575 | 9/1955 | Merrifield | 118/415 X |
| 3,018,199 | 1/1962 | Lit et al. | 118/125 X |
| 3,084,662 | 4/1963 | Badger | 118/404 X |

*Primary Examiner*—John P. McIntosh

*Attorney, Agent, or Firm*—Flehr, Hohbach, Test, et al.

[57] ABSTRACT

A coating system utilizing application under vacuum technology in which entrance and exit ports for the material to be coated are defined by a pair of horizontal gates and a pair of vertical gates at the inlet and outlet apertures of the coating chamber. A mounting arrangement at each port mounts the top vertical gate and the two horizontal gates in sliding relation with associated edges of the inlet and outlet apertures. Positioning arrangements are provided for each of the slidably mounted gates for setting an initial position of the associated gate, and each gate is provided with spring means for biasing that gate toward its initial position. A dimension sensing-adjusting arrangement is provided with a dimension sensing element mounted in the coating chamber by a mounting arrangement which enables the dimension-sensing element to detect strips of larger than normal thickness and automatically adjust the vertical position of the top vertical gate at the exit port to maintain clearance between the bottom edge of that gate and units of material passing through the exit port. In one embodiment, a masking element is provided between the entrance and exit ports to preclude application of coating material on preselected surface portions of material passing through the chamber.

20 Claims, 22 Drawing Figures

COATING SYSTEM

This invention relates in general to coating systems and, more specifically, to systems for coating material utilizing application under vacuum technology.

During the past several years, there has been increasing utilization of coating systems which incorporate the application under vacuum technology exemplified in Badger U.S. Pat. No. 3,084,662. The basic principle of the Badger type coating system involves the confinement of a mass of coating material in an application chamber above which a vacuum is formed so that a continuous flow of air will be induced into the coating chamber around the periphery of units of strip material positioned within entrance and exit ports defined in opposite walls of the chamber. This flow of air serves to seal the entrance and exit ports, to remove excess amounts of coating material on surface portions of units of strip material exiting the chamber, and at least partly to dry the coating on the exiting surfaces. The unique Badger system produces a finished coating that is very uniform, and, with stain coating materials, nearly dry.

Since the introduction of the Badger coating concept, some minor improvements have been made in the technology, including utilizing sliding gates at the entrance and exit ports of the application chamber to expedite the changing of entrance and exit port dimensions. However, after the positions of these sliding gates are adjusted, they are held rigidly in the adjusted position to provide exit and entrance ports of fixed dimensions. Fixed extrance and exit port dimensions would be satisfactory if the dimensions of strip material being conveyed through the coating chamber were always constant. As is well known, many types of strip material, particularly fencing lumber strips and the like, have dimensions which can vary substantially from strip-to-strip. Where such variations in strip material dimensions are encountered, the use of rigidly fixed entrance and exit port dimensions can result in an oversize unit binding up in the application chamber.

More importantly, the Badger coating system technology relies on maintaining a small air gap between surface portions of units of strip material and the sides of the exit port so that accurate, uniform control over the thickness and the integrity of the coating on the strip material can be maintained. Obviously, units of strip material having dimensions substantially larger than normal would at least have one surface touch one of the edges of the exit port marring the coating on the touching surface. This marring is particularly undesirable where the coating is a finish coat of paint and is especially objectionable if marring occurs on the top surface of the board due to contact with the top edge of the exit port.

Another limitation of the previous Badger type systems is that all surfaces of units passing through the chamber are always coated. In some instances, it is preferable not to coat certain surfaces or portions of surfaces of particular types of strip material. In previous coating systems attempts have been made to utilize wipers outside the coating chamber to remove the coating from one or more surfaces or surface portions of strip material exiting the coating chamber. Applying a coating to all surfaces when only portions of the total surface area needs to be coated wastes coating material and often complicates handling and treatment of the finished product. Attempts to use a wiper to remove the coating off the undesired surface portions generally produces an unsatisfactory overall result, especially in the Badger-type system in which the coating on exiting surfaces is at least partly dried by the air rushing in the exit port.

It is a principal object of this invention to provide a coating system which includes improved entrance and exit port defining structures which are both easy to adjust and are capable of automatically responding to changes in the dimensions of units of material entering and exiting the coating chamber.

It is another object of this invention to provide a coating system in which marring of the top surface of oversize units is avoided.

It is a further object of this invention to provide a coating system capable of applying a coating selectively to predetermined surface portions of units of material passing through the coating chamber.

This invention generally features a coating sytem for continuous application of liquid coating material onto the surfaces of successive units of material having varying cross-sectional dimensions passing through a coating chamber. The coating chamber is substantially closed to the atmosphere for containing a substantial head of liquid coating material and defines an inlet aperture and an outlet aperture generally conforming to the dimensions of the largest cross-section of material to be coated in the chamber. The inlet and outlet apertures are located on opposite sides of the chamber in substantial alignment with each other and at a level in the chamber where substantial hydrostatic pressure of the liquid coating material will be maintained. Port defining means are mounted over each of the inlet and outlet apertures for providing entrance and exit ports of adjustable dimensions. Each of the port defining means comprises at least one gate, gate mounting means for mounting the gate in sliding relation with one of the edges of an associated aperture, positioning means for setting an initial position of the gate, and spring means for biasing the gate toward this initial position. Vacuum means are provided for acting continuously above the level of liquid coating material in the chamber to produce a pressure differential between the interior and exterior of the chamber sufficient to induce a continuous flow of air into the chamber about the periphery of portions of material positioned within the entrance and exit ports and upwardly through the liquid coating material in the chamber.

Another aspect of this invention features dimension sensing means positioned inside the chamber for sensing variations in at least one dimension of units of material passing through the chamber and automatically adjusting the position of the slidably mounted gate at the outlet aperture. In a preferred embodiment, this dimension sensing means comprises a dimension sensing element and means mounting the dimension sensing element inside the chamber in position-communicating-relation with the slidably mounted gate at the outlet aperture and including means for setting an initial position of the dimension sensing element in proximity to one surface of a unit of material of normal dimension passing through the chamber. The dimension sensing element is adapted to contact the leading edge of a unit of material having a dimension larger than the normal dimension and thereupon automatically to adjust the position of the slidably mounted gate to provide an enlarged exit port corresponding to the larger dimension.

In a preferred embodiment of this invention, each port defining means further comprises a pair of additional gates mounted by said gate mounting means in sliding relation with a different one of the edges of an associated aperture, positioning means for setting an initial position of each of the additional gates and spring means for biasing the additional gates toward their initial positions.

Another principal feature of the invention is the provision of a masking element extending between the inlet and outlet apertures of the coating chamber. One surface of this masking element is configured to form a pocket adjacent a preselected portion of at least one surface of units of material passing through the chamber. The masking element causes a stream of air from the exterior of the chamber to pass continuously over the preselected surface portion of units passing through the chamber to preclude application of the coating material thereon. When the masking element is mounted underneath the inlet and outlet apertures, it also serves as a guide means for material passing through the coating chamber.

A coating system in accordance with this invention having one or more of the above-enumerated features, has the advantage of not only providing entrance and exit ports of adjustable dimensions, but providing for automatic adjustment of the entrance and exit port dimensions by oversize units of material within reasonable limits. At the less critical entrance port, the spring biased, slidably mounted gates are preferably provided with outwardly extending bevelled edges such that the leading edge of an oversize unit of material about to enter the chamber can automatically adjust the size of the entrance port by pushing aside one or more of the gates defining that port. This precludes any oversize units of material from hanging up in the entrance port and forcing a shutdown of the apparatus. At the exit port, the provision of two slidably mounted, spring biased horizontal gates with bevelled edges enables adjustment of the width of the exit port by the leading edge of a unit of material wider than normal. The provision of a dimension sensing element within the chamber which is capable of automatically raising the top vertical gate at the exit port when contacted by the leading edge of a unit of material thicker than normal eliminates any possibility of marring the important top surface coating of oversize units. This invention also enables the Badger-type coating system technology to be utilized to coat items with irregular but smoothly-varying width such as boards with scalloped edges, provided the appearance of the coating on the edges is not critical. The horizontal entrance and exit port gates are capable of tracking the varying width of such boards as they pass through the coating chamber. The spring biased horizontal gates would even permit the coating of round or oblong items and thus extends the technology outside the coating of strip materials.

Another advantage of the invention is the ability to preclude coating surface portions of units of material passing through the chamber by utilizing a masking means extending between the entrance and exit ports. Such a selective surface coating feature results in a saving of coating material in coating items not needing coating on all surfaces and enables the technology to be applied in coating applications where it is necessary for at least one of the surfaces to be left uncoated so that the strip material will have at least one breathing surface. Selective surface coating, such as leaving the back surface dry, also has the advantage of simplifying the material handling and treatment of the coated items. Takeaway conveyor systems can contact the dry surface so can be of simpler design. Drying racks or drying ovens can be simplified since the provision of drying air to the uncoated surface is not required. Final packaging of partially dried items without blocking or sticking of the material is easier to achieve.

Other objects, features and advantages of this invention will be apparent from a consideration of the following detailed description, the appended claims and the accompanying drawings.

Figure 1:
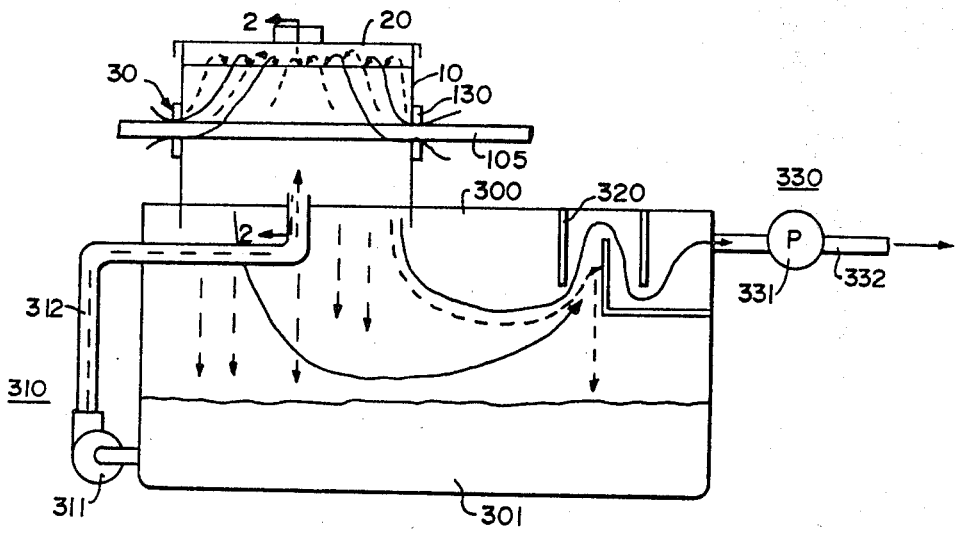
FIG. 1 is a schematic view of a coating system of the type to which this invention is directed.
Figure 2:
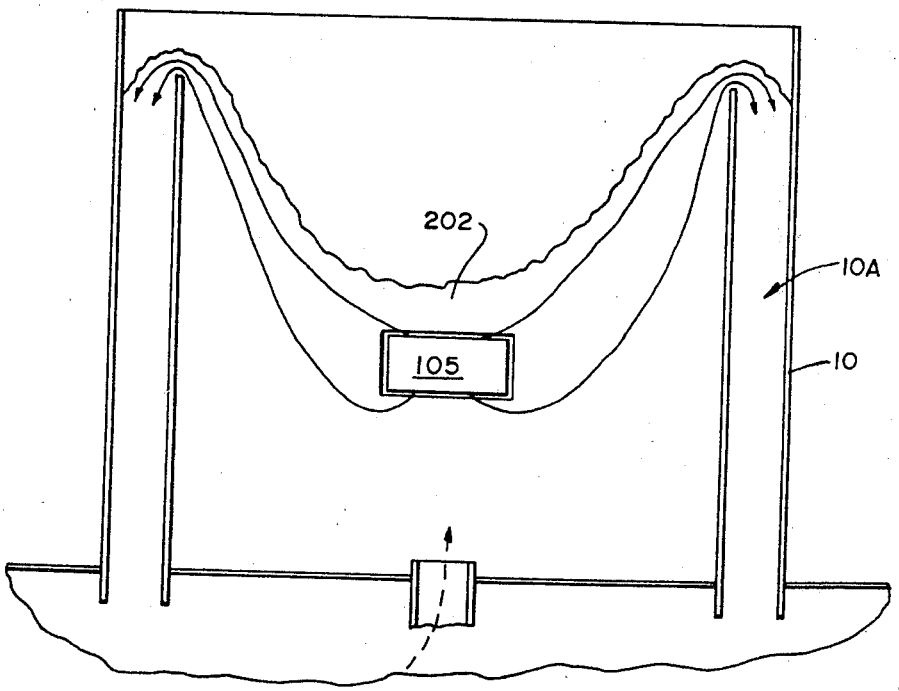
FIG. 2 is a cross-sectional schematic view taken along the lines 2—2 in FIG. 1.

FIGS. 1 and 2 generally illustrate the principles of operation of a Badger-type coating system in which the improvements provided in accordance with this invention may be employed. As shown in FIG. 1, a coating system of the Badger-type generally includes an application chamber 10, a coating reservoir 300, a pumping system 310 for pumping coating from reservoir 300 into application chamber 10, and a vacuum pumping system 330 communicating with the top of reservoir 300 and coating chamber 10 for producing a pressure differential between the exterior and interior of coating chamber 10. Exit port defining means 30 and entrance port defining means 130 generally form entrance and exit ports through which units of material (e.g., unit 105) will be passed. Pumping system 310 includes a pump 311 to deliver liquid coating material 301 stored in reservoir 300 via a piping system 312 to the interior of coating chamber 10. Vacuum pumping system 330 includes a vacuum pump 331 to pump air from the reservoir tank 300 and from the space above the body of liquid coating material 202 in coating chamber 10 (FIG. 2) and through a baffling arrangement generally designated 10A in FIG. 2 and 320 in FIG. 3. The vacuum created above the body of coating material 202 in application chamber 10 causes air to be induced through the small openings in the entrance and exit ports 30 and 130, as shown by solid lines in FIGS. 1 and 2. This stream of air flowing around the periphery of strip material unit 105 seals the entrance and exit ports against any loss of coating and causes a continual exchange of coating material, designated by the dotted lines in FIG. 1 between the application chamber 10 and the reservoir 300. Due to the baffling arrangement, the majority of the coating entrained with the air flow is deposited on the walls of the baffling system and drips back into the reservoir to replenish the body of coating liquid 301. Coating chamber 10 is otherwise sealed with a top 20 such that entry of air can only occur at the entrance and exit ports which are at a location beneath the top of the body 202 of liquid coating material in application chamber 10. The flow of air across the unit of material passing through exit port 30 also strips excess coating material from the surface of the unit at that point. If the liquid coating material is paint, the flow of air across exiting surface portions of unit 105 causes at least partial drying of the paint coating thereon and reduces the subsequent drying time of the coating. If coating material 301 is a stain, the high velocity of flow of air across the surfaces of unit 105 at exit port 30 causes almost complete drying of the stain.

This invention is particularly directed to improvements in the coating system involving the port defining means 30 and 130 at the inlet and outlet apertures and the provision of additional features not previously available in the Badger-type coating system depicted in FIGS. 1 and 2. These additional features include dimension sensing within the chamber in order to adjust automatically one of the exit port gates, and the provision of a masking element within the chamber for preventing the application of coating to at least a part of one surface of a unit of strip material passing through the chamber. The principal components of the improved coating system can best be seen in FIG. 6. The major components are a coating chamber 10, a removable top 20 (FIG. 3) and exit port defining means 30, an entrance port defining means 130, a guide rack arrangement 200, a dimension sensing-adjusting system 210 and a side guide means 230. First consider the structure of coating chamber 10, which can best be seen in FIGS. 6 and 7. Coating chamber 10 comprises a back wall 11 having an inlet aperture 16 therein, a front wall 12 having an outlet aperture 17 therein, a main right side wall 13 and a main left side wall 14 and a bottom 15 which is preferably part of the top wall of reservoir 300. Partial side walls 13A and 14A form the exhaust baffles shown in FIG. 2 through which air and entrained molecules of the liquid coating material travel to the reservoir 300. The front wall 12 of application chamber 10 also has a pair of slots 18 extending through it at a location above outlet aperture 17. These slots are functionality related to the dimension sensing-adjusting system 210 and will be described later in relation thereto. Inlet and outlet apertures 16 and 17 are generally rectangular, are in horizontal alignment with each other, and have dimensions in height and width which correspond to the largest dimensions of material to be coated in coating chamber 10.

Figure 3:
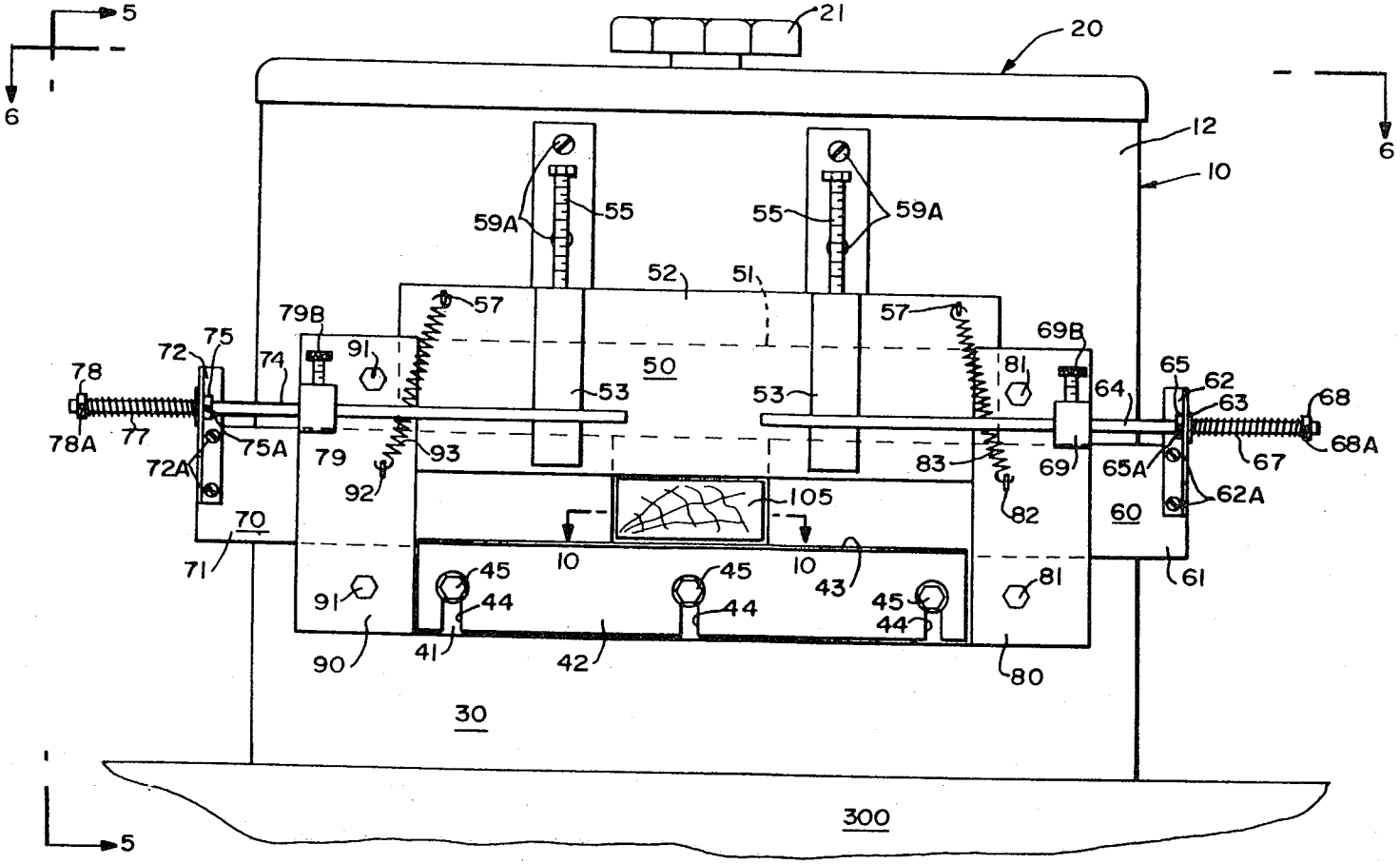
FIG. 3 is a front elevational view of a coating system in accordance with this invention.
Figure 3A:
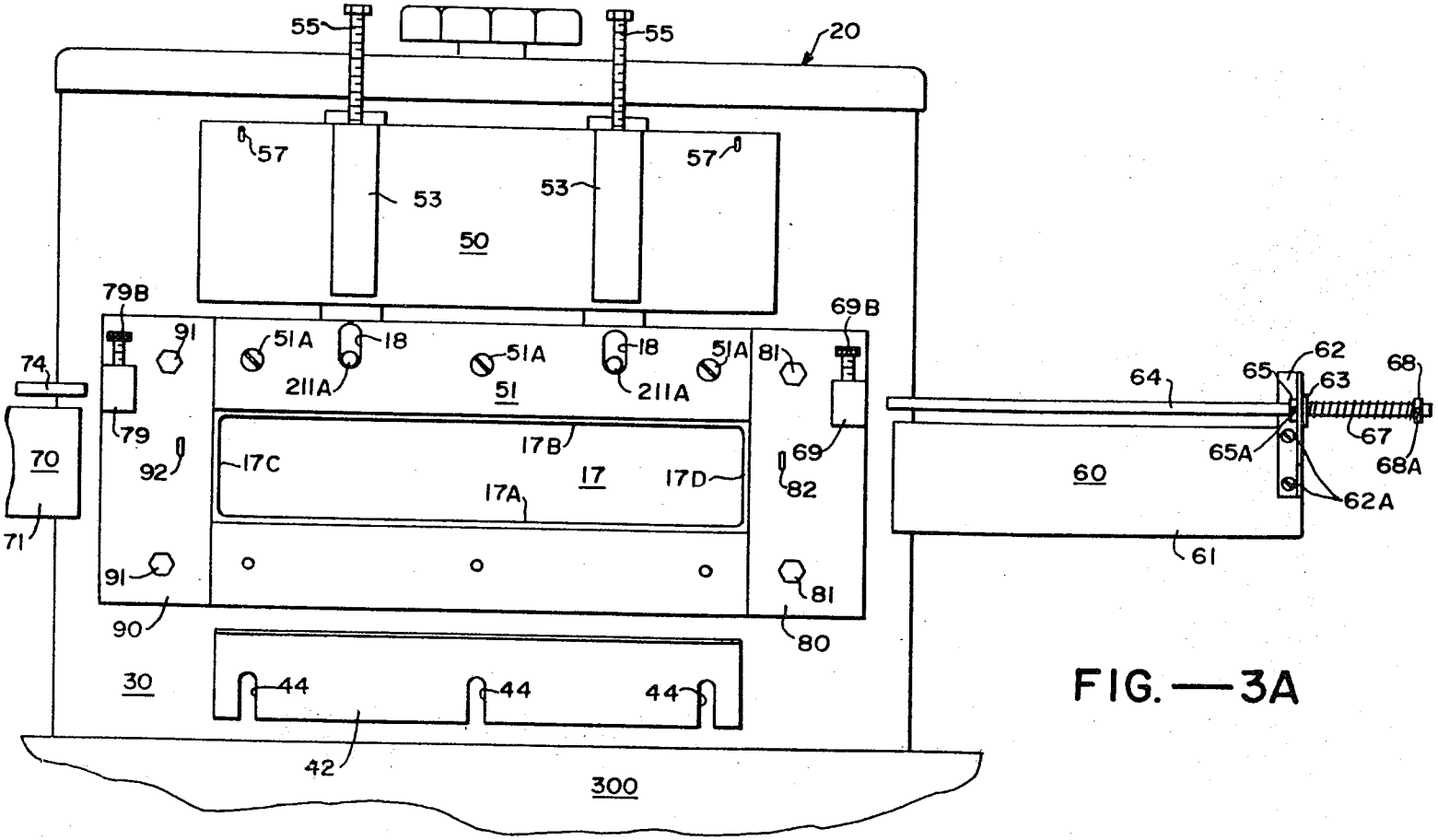
FIG. 3A is a partly exploded front elevation view of a coating system in accordance with this invention.

Exit port defining means 30 will now be described in conjunction with FIGS. 3, 5, 6, and 7. The basic elements of exit port defining means 30 are a pair of vertical gate arrangements 40 and 50, a pair of horizontal gate arrangements 60 and 70, and a mounting frame arrangement comprising bottom and top spacer bars 41 and 51, and a pair of gate retaining bars 80 and 90. The bottom vertical gate arrangement 40 includes a bottom gate 42 which has an L-shaped cross-sectional configuration with a top surface 43 extending transversely from the front wall 12 of chamber 10. Bottom gate 42 is mounted along with bottom spacer bar 41 to the front wall 12 of application chamber 10. This is accomplished by the three bolts 45 which extend through slots 44 in bottom gate 42 and through apertures in bottom spacer bar 41 into threaded holes (not shown) in front wall 12. A gasket or other sealing element (not shown) is preferably utilized behind bottom spacer bar 41 to provide an airtight mounting. As shown in FIG. 3A, the top edge of bottom spacer bar 41 is located just below the bottom edge 17A of outlet aperture 17. Accordingly, when bottom gate 42 is mounted on spacer bar 41, as shown in FIG. 3, a small channel is formed for the bottom edges of horizontal gates 61 and 71.

Figure 7:
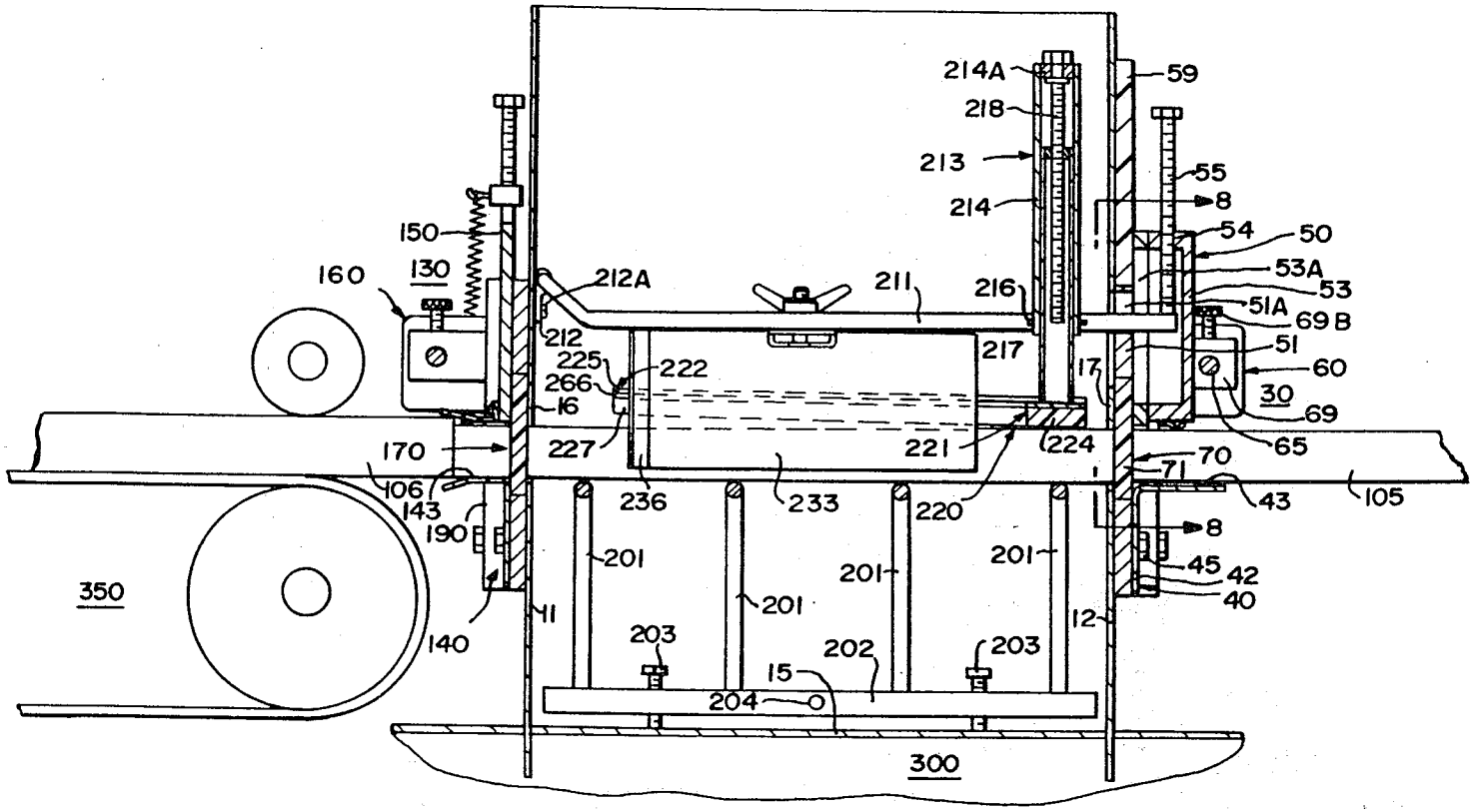
FIG. 7 is a sectioned elevational view of a coating system in accordance with this invention taken along the lines 7—7 in FIG. 6.

As shown in FIG. 3A, top spacer bar 51 is bolted to front wall 12 of application chamber 10 above inlet aperture 17, preferably with an intervening gasket (not shown). The bottom edge of top spacer bar 51 is located slightly above the top edge 17B of inlet aperture 17 to form with top vertical gate 52 a channel for the top edges of horizontal gates 61 and 71. Vertical gate arrangement 50 includes the generally rectangular vertical gate body 52, and a pair of position adjustment housings 53 which have threaded holes 54 in the top portion thereof which receive position adjusting bolts 55. As shown in FIG. 7, the bottoms of position adjusting bolts 55 rest on the end portion 211A of a pair of arms of a U-shaped frame 211 which is part of dimension sensing-adjusting means 210. These arms extend through rear openings 53A into position adjustment housings 53, and position adjusting bolts 55 enable the vertical position of top gate 52 to be adjusted with respect to the arms of frame 211.

Gate retaining bars 80 and 90 are bolted over the top and bottom spacer bars 41 and 51 by way of bolts 81 and 91. Gate retaining bars 80 and 90 each have front lips 84 and 94 (best seen in FIG. 6) which form with top spacer bar 51 a channel which receives the side portions 58 of top vertical gate 52. This provides a slide mounting arrangement for top vertical gate. A pair of tension springs 83 and 93 extend between spring hooks 57 on top vertical gate 52 and a pair of eyelets 82 and 92 mounted in gate retaining bars 80 and 90. Tension springs 83 and 93 bias top vertical gate 52 toward the initial vertical position set by the position adjustment screws 55.

What has been provided, then, is a vertical gate 52, which is mounted by mounting means comprising gate retaining bars 80 and 90 and top spacer bar 51 in sliding relation with the top edge 17B of aperture 17 in front wall 12 of application chamber 10. Furthermore, positioning means comprising the position adjustment housings 53 and position adjusting bolts 55 received in threaded holes 54 enable the setting of an initial position of top vertical gate 52, and in particular, the setting of an initial position of the bottom of that gate to define the height of an exit port. In addition, spring means comprising tension springs 83 and 93 are provided for biasing the top vertical gate 52 towards its initial position. Sealing guide bars 59 are mounted on front wall 12 to prevent substantial flow of air through openings 53A in the position adjustment housings 53 when the coating system is in operation.

It should be understood that it is within the broad concept of this invention to provide a single sliding gate arrangement as the port defining means. This would be useful, for example, in applications where all of the units of material to be coated in the system have a width substantially corresponding to the width of aperture 17 and only the thickness of the material is varied. A top vertical gate arrangement would be sufficient to provide exit port defining means having the requisite adjustable vertical dimension and the top and bottom spacer bars 41 and 51 could be eliminated. In the preferred embodiment shown in the drawings, however, a pair of horizontal gate arrangements are also provided in order to provide control over the width of the exit port.

Figure 5:
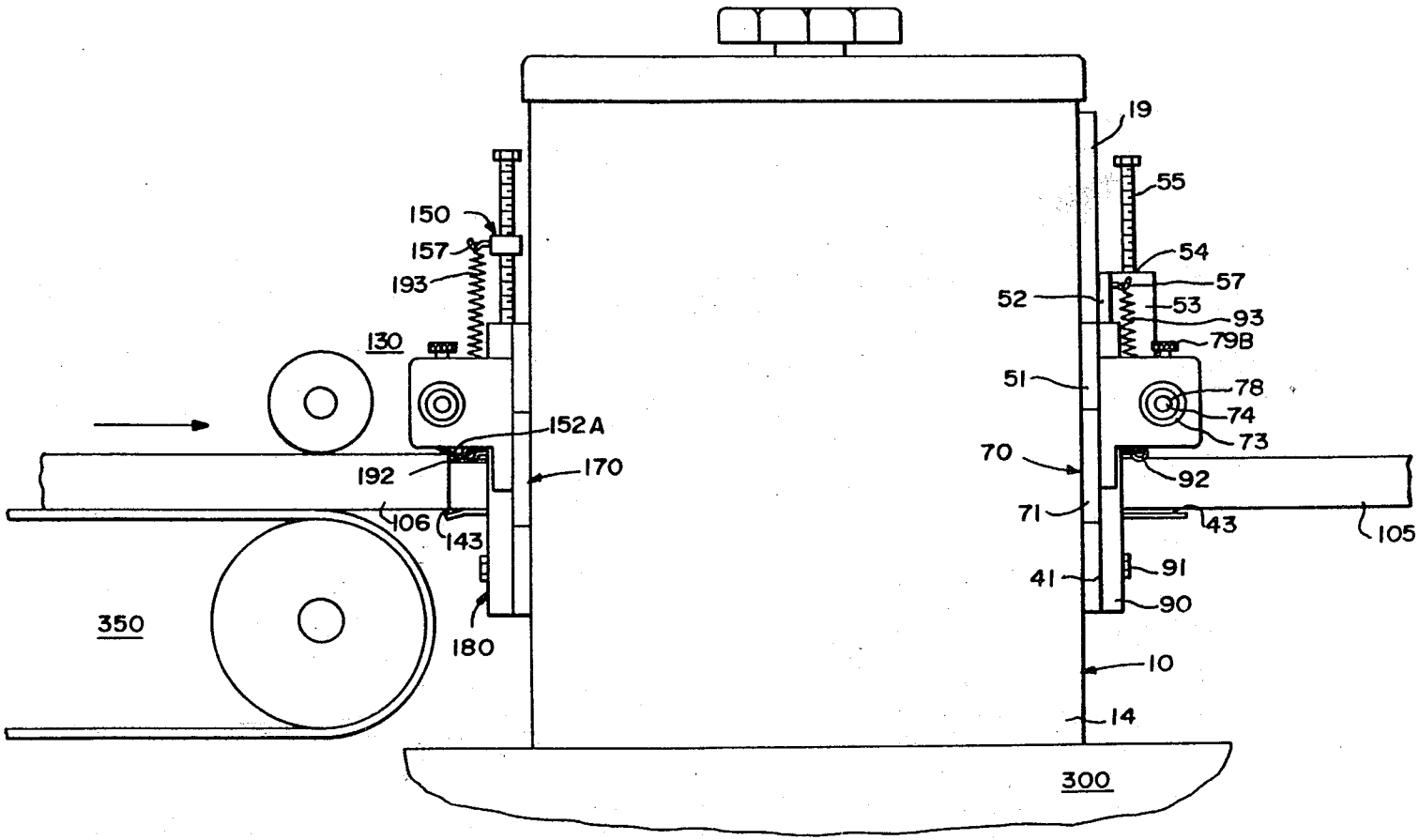
FIG. 5 is a side elevation view of a coating system in accordance with this invention taken along the lines 5—5 in FIG. 3.
Figure 6:
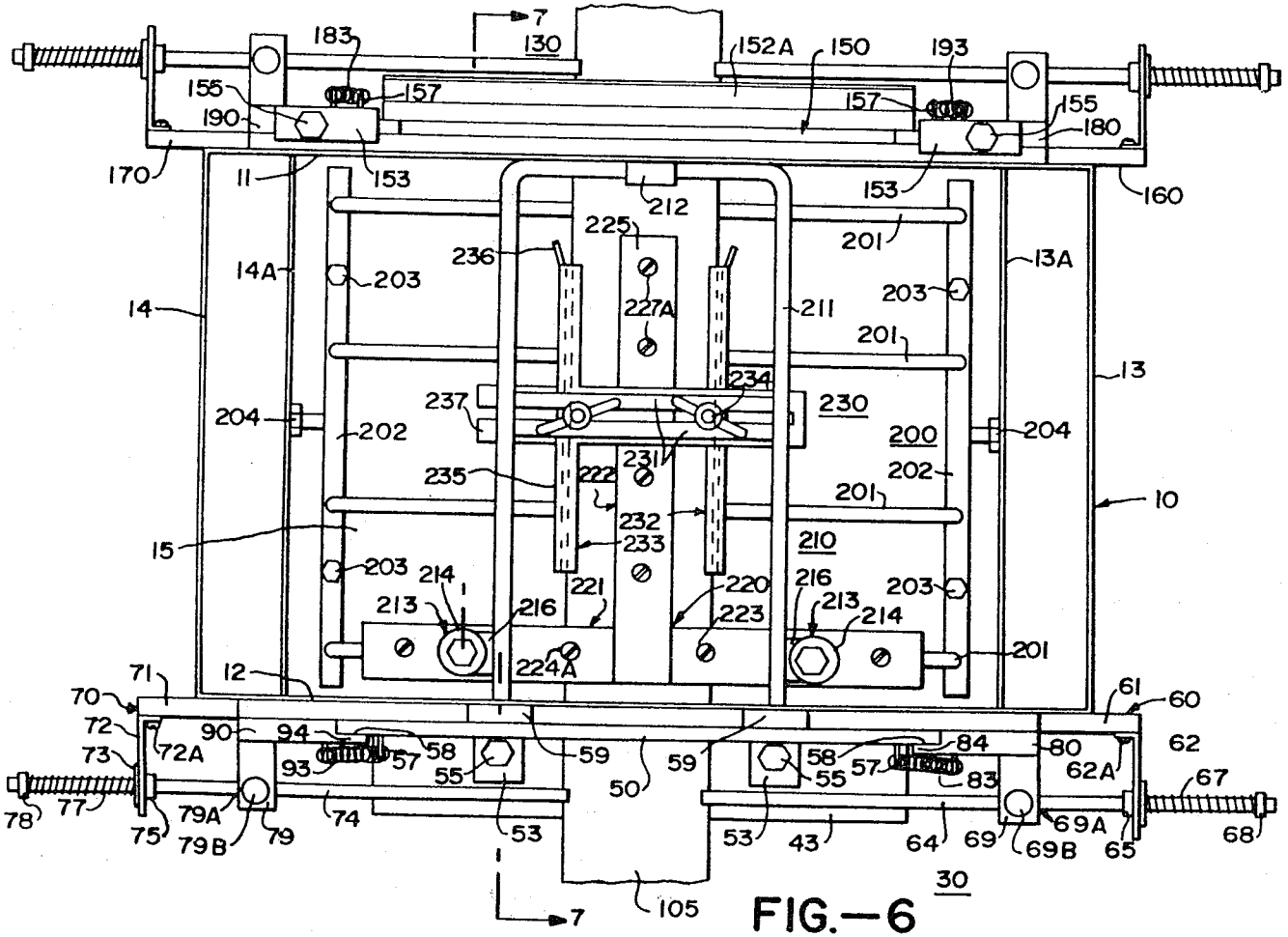
FIG. 6 is a top view of a coating system in accordance with this invention taken along the lines 6—6 in FIG. 3.

As can be seen in FIG. 3, the horizontal gate arrangements 60 and 70 comprise mirror image structures. Consequently, these arrangements can be described together, utilizing the corresponding reference numerals associated with each. Horizontal gate arrangements 60 and 70 generally comprise a horizontal gate member 61, 71 which are mounted in sliding relation over the outlet aperture 17 by channels formed between top and bottom spacer bars 51 and 41 and gate retaining bars 80 and 90. At outside ends of the gate elements 61, 71, gate slide brackets 62, 72 are mounted with mounting screws 62A, 72A. As shown in FIGS. 5 and 6, gate slide brackets 62, 72 generally extend transversely to gate elements 61 and 71 and have apertures therein (not shown). Slide rods 64, 74 are received in these apertures and a stop position collars 65, 75 are carried on slide rods 64, 74 in order to establish a maximum inward position of gate slide bracket 62, 72 on slide rods 64, 74. Slide rod brackets 69, 79 are mounted on gate retaining bars 80 and 90, and have apertures 69A, 79A therethrough in horizontal registration with apertures in gate slide brackets 62, 72. Slide rods 64, 74 are received in apertures 69A, 79A and position adjusting bolts 69B, 79B are provided to lock slide rods 64, 74 in a fixed positions which define the initial positions of gate brackets 62, 72 and gates 61, 71. Compression springs 67, 77 and washers 63, 73 are carried on the ends of slide rods 64, 74 outside of gate slide brackets 62, 72 and are retained on slide rods 64, 74 by collars 68, 78. The degree of compression of springs 67, 77 and thus the spring force biasing gates 61, 71 toward their initial positions can be set by the positions of retaining collars 68, 78. Retaining collars 68, 78 have collar set screws 68A, 78A which enables this position adjustment.

It can thus be seen that what is provided in horizontal gate arrangements 60 and 70 are a pair of horizontal gates 61 and 71 with mounting means provided by top and bottom spacer bars 51 and 41 and gate retaining bars 80 and 90 mounting these additional horizontal gates in sliding relation with the edges 17C and 17D of outlet aperture 17. Gate slide brackets 62, 72, together with slide rods 64, 74 and slide rod position brackets 69, 79, provide positioning means for setting the initial positions of each of the horizontal gates 61 and 71. The compression springs 67, 77 and retaining collars 68, 78 comprise spring means for biasing the horizontal gates 61 and 71 toward their initial positions.

It will be appreciated by those skilled in the art that several alternative approaches could be utilized to provide the positioning means and the spring means for these horizontal gates 61 and 71. For example, an adjustment bracket and bolt arrangement could be provided on the ends of each gate for setting the initial position of the horizontal gates with respect to the outside edges of gate retaining bars 80 and 90 and a tension spring extending between the gates 61 and 71 and respective gate retaining brackets 80 and 90 could be provided for biasing the horizontal gates 61 and 71 toward their initial positions. However, the arrangement depicted (e.g., FIGS. 3, 5 and 6) and described above is preferred because it provides a constant spring biasing force urging the gates toward their initial positions regardless of the particular initial position of the gate. In addition, it will be appreciated that, if the gates 61 and 71 are set in initial positions which provide a very wide exit port, the slide rods 64, 74 provide additional stability to the slide mounting of the horizontal gate structure at such extreme initial position settings.

As can be seen from a consideration of FIGS. 4, 5, 6, and 7, the respective elements and arrangement of entrance port defining means 130 are very similar to those of exit port defining means 30. Consequently, only the difference in structure and arrangement of entrance port defining means 130 need be described. As shown particularly in FIGS. 5 and 7, the top surface 143 of bottom gate 142 is bevelled outwardly away from the surface of a unit of material entering the entrance port in order to provide a guide surface leading the leading edge of an oversize or warped end of a unit of material into the entrance port. Similarly, an outwardly bevelled gate bottom 152A is mounted with mounting screws 152B on the top vertical gate 152. This outwardly bevelled element enables the leading edge of an oversize unit of material to contact the bottom of that bevelled surface to automatically increase the height of the entrance port by pushing gate 152 up against the pressure of tension springs 183 and 193. The horizontal gate arrangements 160 and 170 are identical with the horizontal gate arrangements 60 and 70 of entrance port defining means 30 in FIG. 3 with the exception of one detail later to be described.

With respect to top vertical gate 152, a different positioning means is provided and no position adjustment housings are included. In this case, a pair of ears 153 are formed on the top of gate element 152 with threaded apertures 154 extending through each of the ears 153. Threaded apertures 154 receive bolts 155 with the bottoms of bolts 155 adapted to contact the top surface of gate retaining bars 180 and 190 in order to set the initial vertical position of top vertical gate 152. The tension springs 183,193 are mounted between a spring retaining hooks 157 carried on ears 153 and spring retaining eyes 182,192 carried on gate retaining bars 180,190. As will later be seen, the differences between the top vertical gate arrangement 150 of entrance port defining means 130 and top vertical gate arrangement 50 of exit port defining means 30 are based on the functional relationship between dimension sensing-adjustment arrangement 210 within chamber 10 and top vertical gate arrangement 50. It should be understood that the dimension sensing-adjusting system 210 is an optional, albeit preferred, feature of the invention, and if it were not present, the exit port defining means 30 could be virtually identical to entrance port defining means 130.

Figure 4:
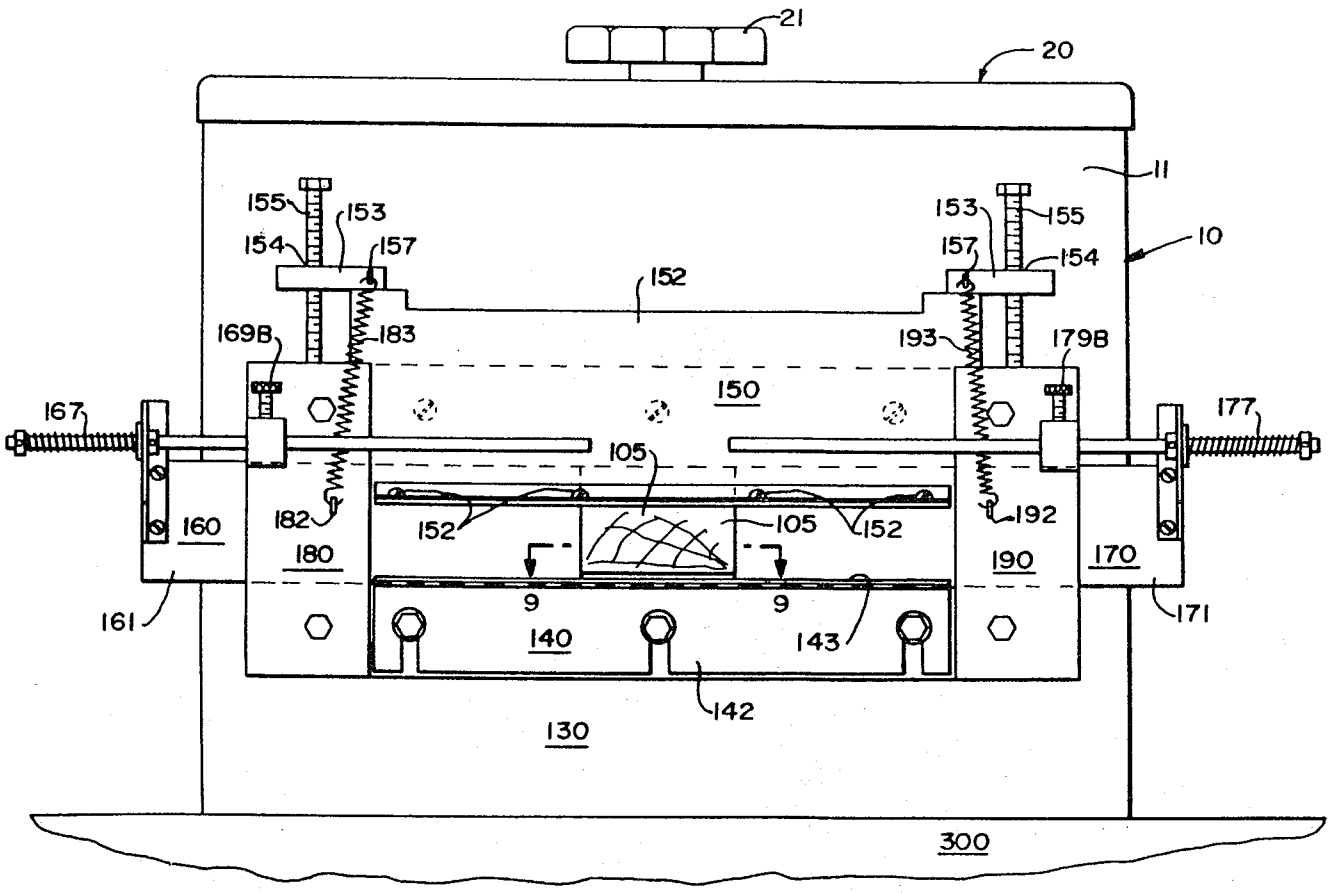
FIG. 4 is a back elevational view of a coating system in accordance with this invention.

It will be apparent to those skilled in this art that the positioning means for setting the initial position of top vertical gate 152 and the spring means for biasing top vertical gate 152 towards the initial position which are depicted in FIG. 4 are just one approach that could be taken and other alternative arrangements could be employed. For example, a slide rod and compression spring arrangement as utilized for horizontal gate arrangements 160 and 170 could be provided also for top vertical gate 152. Consequently, this invention is not limited to any particular positioning means or spring means for the top vertical gate.

Guide rack arrangement 200 located in the bottom of coating chamber 10 can best be seen in FIGS. 6 and 7. Guide rack arrangement 200 basically comprises a plurality of generally U-shaped guide rods 201 having their ends fastened in a pair of guide rod base elements 202. Four bolts 203 extending through guide rod base elements 202 are provided for adjusting the vertical height of the guide rods 201 with respect to the bottom edges of inlet and outlet apertures 16 and 17. Another pair of bolts 204 extending through the sides of guide rod base elements 202 are adapted to contact the inside surface of walls 13A and 14A to retain guide rack 200 in position in coating chamber 10.

As shown in FIG. 7, the top surfaces of guide rods 201 are positioned just slightly above the bottom edges of inlet and outlet apertures 16 and 17 so that guide rods 201 will guide units of material through the coating chamber at a height slightly above the bottom surfaces of the entrance and exit ports. It will be appreciated by those skilled in the art that numerous other approaches to providing a guide rack could be utilized, including some of the advantageous approaches discussed below in connection with another feature of this invention.

Figure 8:
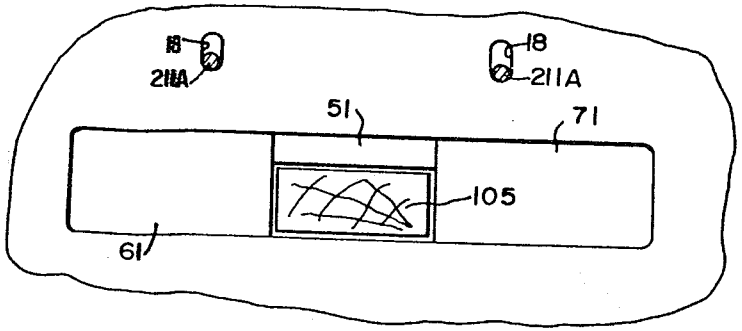
FIG. 8 is a partial view taken along the lines 8—8 in FIG. 7.
Figure 7A:
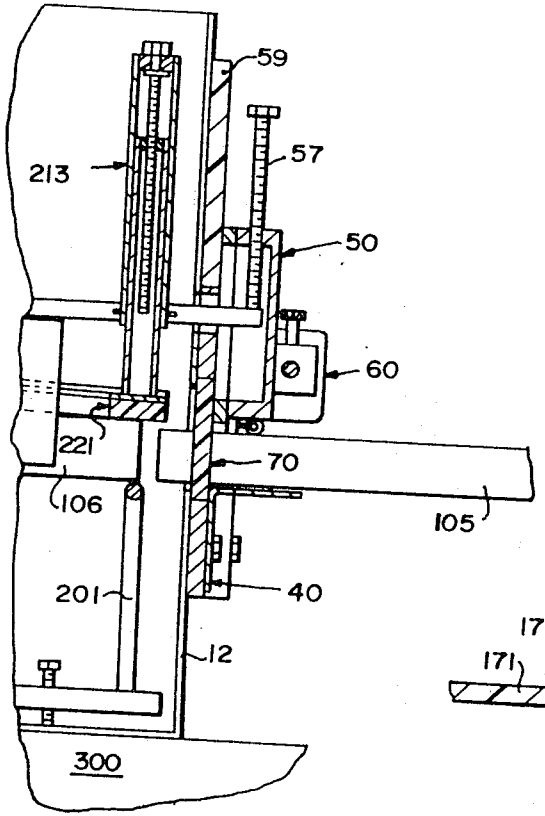
FIG. 7A is a partial section view useful in explaining one feature of this invention.

The dimension sensing-adjusting arrangement 210 may best be described in conjunction with FIGS. 6, 7 and 7A. The general elements of the dimension sensing-adjusting arrangement are a U-shaped frame 211, a pair of telescoping column assemblies 213, and a T-shaped sensing head assembly 220. U-shaped frame 211 is pivotally mounted on the rear wall 11 of coating chamber 10 with a mounting bracket 212 affixed to rear wall 11 with a mounting screw 212A. Front leg portions 211A of U-shaped frame 211 extend through a pair of slots 18 in front wall 12 of coating chamber 10, through a pair of slots 51A in top spacer bar 51, and through a pair of openings 53A in the back of position adjusting housings 53 as shown in FIGS. 7 and 8.

The telescoping column arrangements 213 comprise an outer column 214 and an inner column 215 and a threaded captive stud 218 which extends through an aperture 214A in the top of outer column 214 and into a threaded hole 217 in the top of inner column 215. A retaining washer 218A welded to stud 218 below aperture 214A captivates stud 218 and enables it to adjust the position of inner column 215 with respect to outer column 214.

The T-shaped sensing assembly 220 is carried on the bottom of inner column 215 of telescoping column arrangement 213. This T-shaped sensing head assembly 220 generally comprises a transverse bar assembly 221 and a longitudinal bar assembly 222. The transverse bar assembly comprises two separate sections, a top bar 223 (preferably steel) which is fastened onto the bottom of inner column 215, and a bottom bar 224 (preferably plastic, e.g. DELRIN) which is fastened to the top bar 223 with screws 224A. The longitudinal bar assembly 222 comprises a top bar 225 (preferably steel) which is attached at the front to the top of bar member 223 (e.g. by spot welding) and intermediate bar 226 (preferably steel) and a bottom bar 227 (preferably plastic, e.g. DELRIN). These respective bars of the longitudinal bar assembly are fastened together with screws 227A.

What has been provided then is a dimension sensing element in the form of the T-shaped sensing head assembly 220 and mounting means comprising U-shaped frame 211 and telescoping column arrangement 213 for mounting the dimension sensing element inside the coating chamber 10. The extension of the legs of U-shaped frame 211 into the position adjustment housings 53 of top vertical gate 52 provides a position-communicating-relation between the dimension sensing element (i.e., sensing head assembly 220) and vertical gate 52. The telescoping column arrangements 213 comprise element positioning means for setting an initial position of the dimension sensing element a short distance above the top surface of a unit of material of normal dimension extending through the chamber.

It will be appreciated by those skilled in this art that various alternative approaches could be taken to providing a dimension sensing element and mounting that element in position-communicating-relation with vertical gate 52. In particular, U-shaped frame 211 is just one type of frame that could be utilized and could be replaced with a solid bar of material pivotally mounted at the back wall of chamber 10 and extending through a single slot in front wall 17 and top spacer bar 51 into a single position adjusting housing associated with gate 52. Instead of telescoping columns for adjusting the position of the T-shaped sensing head assembly 220, other arrangements such as slide bars and set screw brackets could be employed. The dimension sensing element itself could have a variety of different configurations and still perform the same function. The arrangement depicted is preferred, however, since it provides for positioning the principally acting component of the dimension sensing means at the front of the inside of the coating chamber where it can cooperate with the long lever arm provided by U-shaped frame 211 to control the time at which the total force against the dimension sensing element is sufficient to overcome the biasing force of springs 83 and 93 to change the vertical position of gate 52.

FIGS. 6 and 7 also depict a side guide assembly 230 which is carried on U-shaped frame 211 of the dimension sensing system 210. The side guide arrangement 230 generally comprises a pair of mounting bars 231 having their ends welded to the legs of frame 211, a right guide element 232, a left guide element 233, and a pair of bolt and wing nut arrangements 234 utilized to fasten the left and right guides to the mounting bars 231. As shown, each of the right and left guides has a vertical guide section 235 extending below U-shaped frame 211 having an outwardly bent rear section 236 which is adapted to lead any misaligned pieces of material into the guides to maintain side-to-side registration of the material passing through the chamber. The slotted mounting arms 237 attached to each of the right and left guide elements 232 and 233 cooperate with the bolt and wing nut assemblies 234 to enable the guides to be selectively positioned at various separation distances to provide a side guide function to materials of different widths.

Having described the structure of several major features of a coating system in accordance with this invention, the basic functional setup and operation of the apparatus will now be described, with particular attention to initial setup of the equipment and the response of the various features to oversize units of material entering and passing through coating chamber 10. Consider first the initial setup of the apparatus. The setup procedure starts with the entrance and exit port defining means 30 and 130 arranged such that the vertical and horizontal gates are at positions which permit introduction of a sample unit of the type of material to be coated into the coating chamber as a gage for proper setting of entrance and exit port dimensions. Consider first the setting of entrance port dimensions in conjunction with FIG. 4. Once the sample unit of material 105 is placed within a central portion of the entrance port, the slidably mounted gates 161 and 171 are moved in until their respective inward edges are just in contact with the sides of the unit 105. Then, the thumb screws 169B and 179B are tightened to establish those positions of gates 161 and 171 as initial positions. Next, the top vertical gate 152 is lowered via the position setting studs 155 until the bottom surface of gate 152 is in contact with the top surface of unit 105. This establishes the initial position of vertical gate 152. The initial entrance port dimensions are thus established.

The next step is to set up the position of the T-shaped sensing head assembly 220. With the arms of mounting frame 211 resting in the bottom of slots 18 in the front wall 12 of coating chamber 10, the position of the inner columns 215 of the telescoping column 213 are adjusted by way of the threaded studs 218 until the bottom surface of the transverse bar 221 is positioned a slight distance (e.g., about one-sixteenth of an inch) above the top surface of unit 105. As shown in FIG. 7, the longitudinal bar 222 is canted slightly up from the level of the transverse bar 221 when the transverse bar 221 is in position above unit 105.

As shown in FIG. 7, the bottom surface of unit 105 is positioned by the feed rollers generally designated by the reference 350 above the top surface 143 of the bottom vertical gate 142 of the entrance port defining means 130. The guide bars 201 of guide rack assembly 200 carry the unit of strip material at a level above the bottom edges of the inlet and outlet apertures 16 and 17, so that the unit of material will have a small air gap underneath it at the exit port. If necessary, the height of the guide rods 201 is adjusted to provide the desired amount of clearance between the bottom surface of unit 105 and the bottom edge of the inlet and outlet apertures.

The next step is to adjust the size of the exit port dimensions. Referring to FIG. 3, the first step in making this adjustment would be to slide the horizontal gates 61 and 71 inward until their inner edges are spaced a small distance away from the sides of unit 105. Then the thumbscrews 69B and 79B are tightened to establish these positions of gates 61 and 71 as the initial horizontal gate positions. Next, the vertical position of top gate 52 is adjusted by means of the position adjusting bolts 55 until the bottom surface of gate 52 is positioned just slightly above the top surface of unit 105. This establishes the initial position of the top vertical gate 52 and completes the calibration of the exit port dimensions.

Once the above setup has been completed, the coating system is ready to be operated to coat successive units of material fed into coating chamber 10 by way of the conveyor feed system 350. It should be understood that there is also provided at the exit port some type of take-away conveyor (not shown). To initiate the operation of the unit, the vacuum pump 331 shown in FIG. 1 is started, and a short time later, the coating pump 311 is started to begin to fill coating chamber 10 with the liquid coating material to be utilized on material units 105. After a sufficient volume of coating liquid is introduced into coating chamber 10, the conveyor apparatus is started and successive units of material are fed through the coating chamber. Individual units of material may be conveyed through the coating chamber at speeds in excess of four hundred feet per minute.

Successive units of material having substantially normal dimension for which the apparatus was initially calibrated will pass through the chamber without any change in position of any of the elements of the entrance port defining means 130, the dimension sensing means 210 or the exit port defining means 30. Consider, however, the response of the coating system to an oversize unit of material 106 being fed into the entrance port as depicted in FIG. 5. The first thing that will happen is that the leading edge of unit 106 will contact the outwardly tapered edge surface 152A of top vertical gate 151. The bevelled element will lead the leading edge of unit 106 into the entrance port and gradually push the top gate 151 upward against the force of springs 183 and 193, thereby enlarging the height of the entrance port. Referring to FIG. 7, the next thing that will happen is that the leading edge of unit 106 will contact the bottom of the longitudinal bar assembly 222 at some point along the extend thereof and be led into the transverse sensing bar 221. As the leading edge of unit 106 reaches the front region of the application chamber 10 and contacts the bottom of transverse sensing bar 221, it pushes sensing bar 221, the telescoping column assembly 213 and the front of U-shaped frame 211 upward as frame 211 pivots with respect to its rear pivot points. Accordingly, the front portion 211A of frame raises up against the force of tension springs 83 and 93. This causes the top gate 51 of the exit port defining means 30 to be raised a sufficient amount to maintain a small amount of clearance between the bottom surface of gate 51 and the top surface of unit 106 as it passes through the exit port. Because of the spacing between the telescoping column arrangements 213 and vertical gate 51, the amount of upward movement of gate 51 will be slightly greater than that of the sensor bar 221, thus insuring the maintenance of a small air gap between the bottom of gate 51 and the top surface of an oversize unit 106.

This dimension sensing-adjusting feature is especially important when the coating system is utilized to coat units of material such as fence boards which may vary as much as one-quarter inch in thickness. With the dimension sensing and adjusting feature provided by this invention, such units of widely varying dimensions can be coated without marring the top surface coating by contact which would otherwise be made between the bottom of the top gate 52 and the top surface of the oversize units.

Figure 10:
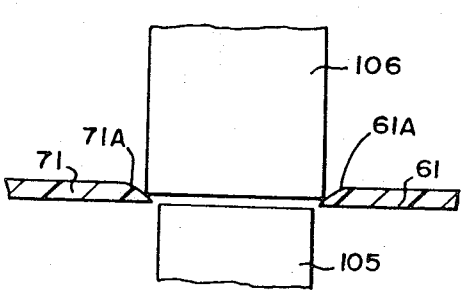
FIG. 10 is a partial section view taken along the lines 10—10 in FIG. 3.
Figure 9:
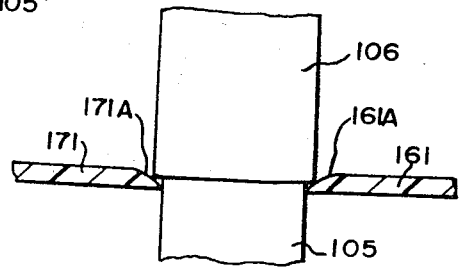
FIG. 9 is a partial section view taken along the lines 9—9 in FIG. 4.

FIGS. 9 and 10 illustrate how the coating system in accordance with this invention is also capable of handling units of material having a greater than normal calibrated width. Consider first a unit of material 106 arriving at the entrance port and having an oversize width. As shown in FIG. 9, the inside edges 161A and 171A of horizontal gates 161 and 171 are outwardly bevelled. Consequently, when wider unit 106 of material arrives at the entrance port, the leading side edges of wider unit 106 make contact with the bevelled edges 161A and 171A and provide a force against gates 161 and 171 which has a horizontal component. This horizontal component of the force exerted against gates 161 and 171 causes the gates to be moved outwardly against the pressure of springs 167 and 177 shown in FIG. 4. Thus, a wider unit 106 automatically adjusts the size of the entrance port to correspond to the width of the particular unit.

FIG. 10 shows the corresponding action of a wider unit at the exit port. The horizontal gates 61 and 71 of the exit port defining means 130 also have bevelled edges 61A and 71A which are adapted to contact the leading side edges of a an oversized unit 106 to force the gates 61 and 71 outward against the pressure of springs 67 and 77. Contact between the sides of unit 106 and the edges of gates 61 and 71 may cause a slight marring of the coating provided on those side surfaces, but the ability of gates 61 and 71 to adjust to overwide material units eliminates any possiblity of such units jamming in the application chamber, forcing a shutdown of the system. Furthermore, in most instances, the appearance of the coating on the edges of the material is not as important as that of the top surface. A slight marring of the coating on the sides of the unit will, in most instances, not be considered a sufficient defect to require recoating.

From the description of FIGS. 9 and 10 it should also be apparent that the horizontal gates are capable of adjusting to changes in the width of an individual unit of material, for example a scalloped edge on a board.

Figure 11B:
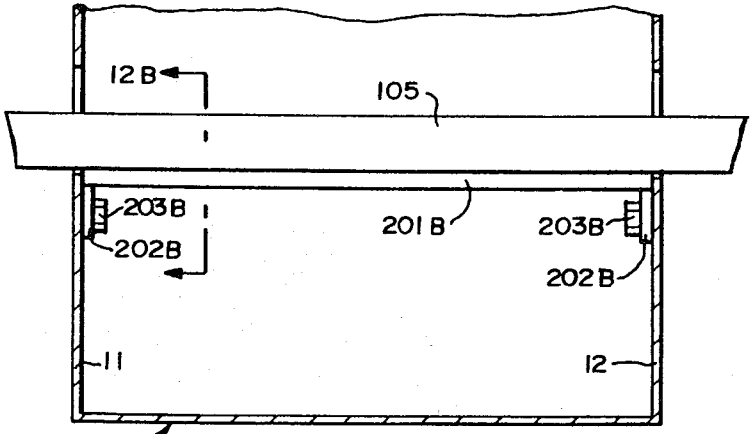
FIGS. 11A and 11B are partial section views showing one feature of this invention.
Figure 11A:
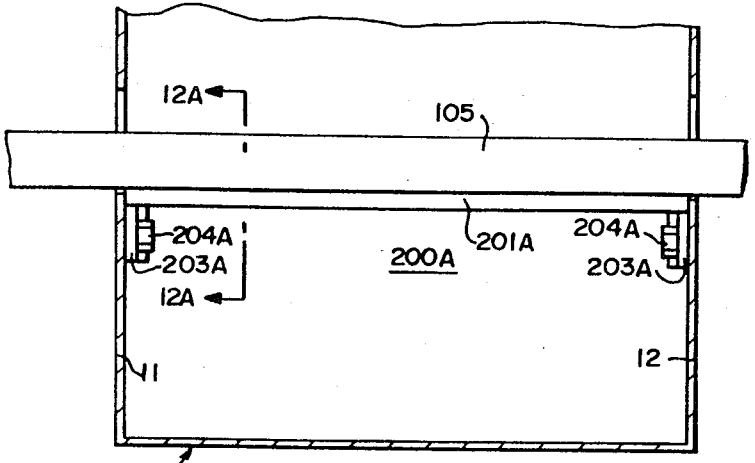
Figure 12B:
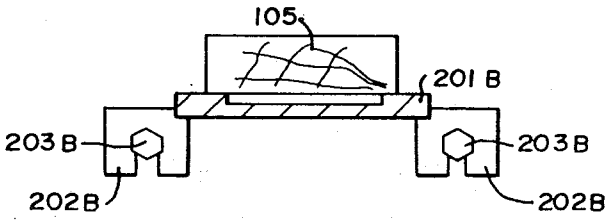
FIGS. 12A and 12B are partial section views taken along the lines 12—12 in FIGS. 11A and 11B.
Figure 12A:
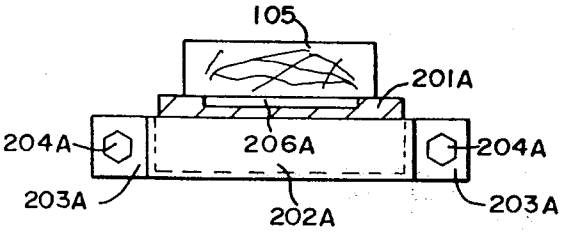

FIGS. 11A and 11B and 12A and 12B depict alternate versions of guide rack assemblies 200A and 200B which perform the dual function of guiding units of material through coating chamber 10 and masking one surface of the material units against the application of coating material thereon. This is an extremely useful feature of this invention since it enables the coating system of this invention to be employed for units of material where it is either necessary or desirable to avoid coating at least some portion of one surface of the material passing through the chamber. FIGS. 11A and 12A show one mounting arrangement for a combined guide and masking arrangement 200A. Guide and masking element 201A extends completely across coating chamber 10 from back wall 11 to front wall 12. As shown in FIG. 12A, a mounting tab 202A is provided at each end of guide and masking element 201A. Mounting brackets 203A are fastened by way of a pair of bolts 204A to the front and back walls of coating chamber 10. As shown in FIG. 12A, the mounting bracket 203A is configured to form a pocket 205A into which mounting tab 202A is received to retain the guide and masking element 201A in position in chamber 10.

As shown in FIG. 12A, guide and masking element 201A forms a pocket 206A underneath the bottom surface of a unit of material 105 extending through chamber 10. This pocket 206A communicates with the small air gap between the bottom surface of unit 105 and the top edges of the inlet and outlet apertures in order to maintain a continuous flow of air through the pocket 206A and over the bottom surface of unit 105. This continuous flow of air precludes the application of coating material onto the bottom surface of unit 105. Generally speaking, the depth of pocket 206A is not critical and may be, for example, around one-quarter inch. In practice, small amounts of coating may be collected in the bottom of pocket 206A, but the continuous flow of air through that pocket and between the top surface of the guide and masking element 201A and the side portions of the bottom surface of unit 105 will prevent any substantial application of coating material on that bottom surface.

FIGS. 11B and 12B depict an alternate way of mounting a guide and masking element 201B to the back and front walls 11 and 12 of coating chamber 10. In the embodiment shown in FIGS. 11B and 12B, a pair of tabs 202B are formed on each end of guide and masking element 201B and a pair of bolts 203B are utilized to fasten tabs 203B to an associated end wall of coating chamber 10. In this fashion, the guide and masking element 201B is rigidly secured in coating chamber 10 between back wall 11 and front wall 12 and functions in the fashion as the guide and masking element 201A shown in FIGS. 11A and 12A. It will be appreciated that the mounting arrangements for the combined guide and masking elements 201A and 201B in FIGS. 11A and 11B and 12A and 12B are merely examples of alternative ways for mounting such an element in coating chamber 10. Numerous alternative approaches could be employed.

Figure 13A:
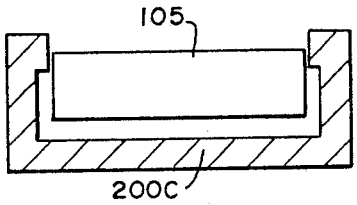
FIGS. 13A and 13B are partial section views illustrating alternative arrangements of one feature of this invention.
Figure 13B:
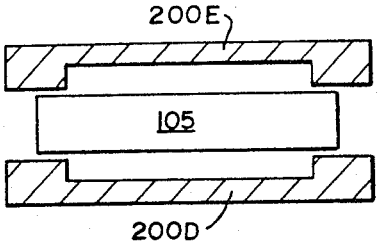

FIGS. 13A and 13B show cross-sectional configurations of other versions of combined guide and masking elements which could be utilized in connection with the coating system of this invention. As shown in FIG. 13A, a combined guide and masking element 200C having the cross-sectional configuration depicted there could be provided to prevent application of liquid coating material to the bottom and both sides of a rectangular unit of material 105 passing through the coating chamber. FIG. 13B generally depicts the combined use of two guide and masking elements 200D and 200E to preclude the application of liquid coating material on both the top and bottom surfaces of the unit 105, thus applying coating only to the edge surfaces of unit 105. It should be appreciated that guide and masking element configurations could also be provided to preclude coating only a portion of one surface of material units.

Figure 14A:
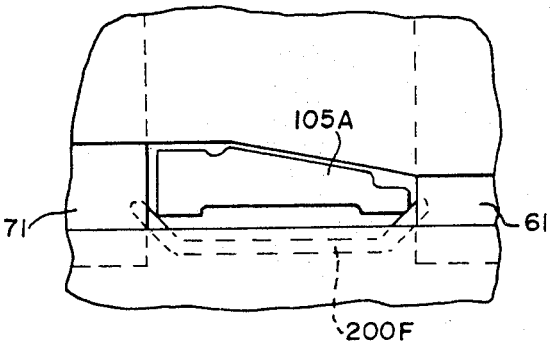
FIGS. 14A and 14B are partial front views illustrating one feature of this invention.
Figure 14B:
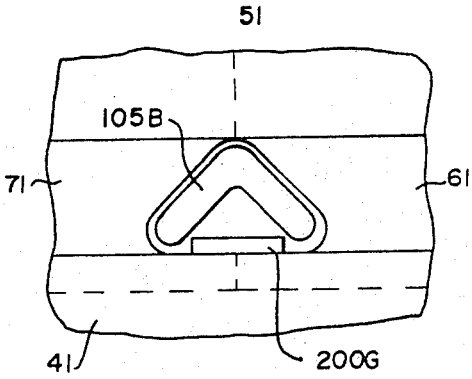

FIGS. 14A and 14B illustrate the capability of the coating system of this invention to be adapted to a selective application of a liquid coating on surfaces of units of material 105A and 105B which have a nonrectangular cross-sectional configuration. As shown in FIG. 14A, appropriate entrance and exit port configurations can be provided for a nonrectangular trim piece 105A by forming a portion of the bottom of vertical gate 52 at the exit port (and vertical gate 152 at the entrance port) to a shape conforming generally to the top portion of the cross-sectional configuration of a decorative molding strip 105A. Unit 105A may be a decorative strip milled out of lumber or it may be an extruded polystyrene molding strip. FIG. 14A also depicts a guide and masking element 200F which is configured to preclude application of coating material (typically a stain) to the bottom surface of molding strip 105A. Since molding strip 105A is a decorative molding usually attached to another surface, there is no need for coating to be applied to the back surface thereof.

FIG. 14B shows a decorative molding having a generally L-shaped cross-sectional configuration being coated in the coating apparatus of this invention. In this case the inner edges of the horizontal gates 61 and 71 (and corresponding entrance port gates 161 and 171) are configured to conform to a portion of the cross-sectional configuration of the L-shaped strip material. A guide and masking element 200G is shown mounted in the coating chamber to preclude coating the interior surface of the L-shaped decorative molding strip 105B but permitting all surface portions that will show, including the bottom edges of the strip, to be coated.

Figure 15A:
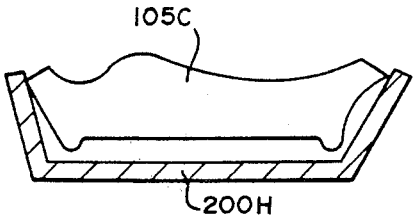
FIGS. 15A and 15B are partial section views of an alternative embodiment of one feature of this invention.
Figure 15B:
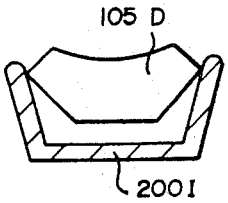

FIGS. 15A and 15B show the configurations of other guide and masking elements 200H and 200I which can be utilized for precluding coating of back surfaces of a large decorative corner molding 105C and a small decorative corner molding 105D.

It can thus be seen that the combined guide and masking element is an important feature of this invention and enables the selective coating of preselected surface portions of units of strip material passing through the coating chamber. As previously stated, the ability to keep one surface dry in coating such things as decorative moldings simplifies the design of take-away conveyors since they can touch the back surface without becoming fouled with coating. It also simplifies drying racks and ovens since the back surface does not have to be dried.

It should be understood that it would also be possible to use separate guide means and masking means within the general scope of this invention. For example, the guide rack arrangement shown in FIGS. 6 and 7 could be used in conjunction with a masking element mounted over the exit and entrance port to preclude coating top surfaces of units.

It should be understood that the utilization of a guide and masking element for preventing the coating from reaching the particular surfaces of a unit of material is not only useful in conjunction with the improved port defining means which is another feature of this invention, but could also be used in coating systems where fixed entrance and exit ports are provided. The dimensional tolerances on decorative moldings, whether of the milled lumber variety or the extruded polystyrene variety, are sufficiently consistent that fixed dimension entrance and exit ports could be utilized with this type of strip material. Accordingly, the combined guide and masking elements or separate guide and masking elements could be utilized in conjunction with this type of strip material in a system where fixed entrance and exit port configurations are provided.

What has been described above is a preferred embodiment of a coating system which provides a number of improvements over prior art systems. The setup of the entrance and exit port dimensions can be accomplished very quickly, making it easy for the user to calibrate the apparatus for coating different batches of strip material having different cross-sectional dimensions. The above-described system provides for the first time the capability of trouble-free coating of types of strip material which may have substantially varying widths and thicknesses because of the system's capability of automatically adjusting the position of the top vertical gate at exit port and the automatic adjustment of the other spring biased gates. The ability of the system to coat only selected surface portions of strip material units adds an additional degree of flexibility in coating apparatus employing the Badger-type technology.

While certain preferred and alternative embodiments of this invention have been described in detail above, it should be understood that numerous modifications could be made in the various features of the described coating system without departing from the scope of this invention. For example, the coating system could utilize inlet and outlet apertures which have a larger height than width and narrow strips could be fed through in a vertical orientation. In such a system the vertical gates described above would become horizontal gates and vice versa. Numerous other modifications could be made within the general concepts of this invention as defined in the claims set forth below.

What is claimed is:

1. In a system for continuous application of a liquid coating material onto the surfaces of successive units of material having varying cross-sectional dimensions, a coating chamber substantially closed to the atmosphere for containing a substantial head of liquid coating material, said coating chamber defining an inlet aperture and an outlet aperture therein generally conforming to the dimensions of the largest cross section of material to be coated in said chamber, said apertures being located on opposite sides of said chamber in substantial alignment with each other and at a level in said chamber where substantial hydrostatic pressure of said liquid coating material will be maintained; port defining means mounted over each of said inlet and outlet apertures for providing entrance and exit ports of adjustable dimensions, each of said port defining means comprising at least one gate, gate mounting means for mounting said gate in sliding relation with one of the edges of an associated aperture, positioning means for setting an initial position of said gate, and spring means for biasing said gate toward said initial position; dimension sensing means positioned inside said chamber for sensing variations in at least one dimension of units of material passing through said chamber and automatically adjusting the position of said slidably mounted gate at said outlet aperture; and means acting continuously above the level of liquid coating material in said chamber to produce a pressure differential between the interior and exterior of said chamber sufficient to induce a continuous flow of air into said chamber about the periphery of portions of material positioned within said entrance and exit ports and upwardly through said liquid coating material in said chamber.

2. Apparatus as claimed in claim 1, wherein said dimension sensing means comprises a dimension sensing element; and means mounting said dimension sensing element inside said chamber in position-communicating-relation with said slidably mounted gate at said outlet aperture, including means for setting an initial position of said dimension sensing element in proximity to one surface of a unit of material of normal dimension passing through said chamber, said dimension sensing element being adapted to contact the leading edge of a unit of material having a dimension larger than said normal dimension and thereupon automatically to adjust the position of said gate to provide an enlarged exit port corresponding to said larger dimension.

3. Apparatus as claimed in claim 1, wherein each of said port defining means further comprises a pair of additional gates, each mounted by said mounting means in sliding relation with a different one of the edges of said associated aperture, positioning means for setting an initial position of each of said additional gates, and spring means for biasing said additional gates toward said initial positions.

4. Apparatus as claimed in claim 3 adapted to coat strip material having a nonrectangular cross-sectional configuration, wherein a portion of one edge of at least one of said slidably mounted gates has a shape substantially conforming to a portion of said nonrectangular cross-sectional configuration of said strip material to provide a port generally conforming to said nonrectangular cross-sectional configuration.

5. Apparatus as claimed in claim 3, wherein each of said slidably mounted gates at said inlet aperture and said additional gates at said outlet aperture each have one outwardly bevelled edge adapted to contact the leading end of one unit of material entering the associated port and having at least one dimension larger than normal to enable said leading end automatically to adjust the position of said gate.

6. Apparatus as claimed in claim 3, wherein each of said additional gates at said inlet and outlet apertures have one outwardly beveled edge adapted to contact the edges of units of material having varying width to enable said units of material automatically to adjust the positions of said additional gates to track the width of the material.

7. In a system for continuous application of a liquid coating material onto the surfaces of successive units of material having varying cross-sectional dimensions, a coating chamber substantially closed to the atmosphere for containing a substantial head of liquid coating material, said coating chamber defining rectangular inlet and outlet apertures therein generally conforming to the dimensions of the largest cross-section of material to be coated in said chamber, said apertures being located on opposite sides of said chamber in substantial horizontal alignment with each other and at a level in said chamber where substantial hydrostatic pressure of said liquid coating material will be maintained; guide means mounted in said coating chamber between said inlet and outlet apertures and adapted to contact the bottom of each unit of material passing through said chamber to guide said material between said apertures and to position the bottom surface of exiting portions of said material a small distance above the bottom edge of said outlet aperture; port defining means mounted over each of said inlet and outlet apertures for providing entrance and exit ports of adjustable dimensions, each of said port defining means comprising a pair of vertical gates and a pair of horizontal gates, mounting means for mounting the bottom one of said vertical gates in a fixed position with a top edge aligned with the bottom edge of an associated aperture and for mounting each of said other gates in sliding relation with a different one of the other edges of said associated aperture, positioning means for setting an initial position of each of said other gates to establish initial minimum dimensions of the exit port slightly larger than cross-sectional dimensions of units of material to be coated and initial minimum dimensions of the entrance port equal to the cross-sectional dimensions of said material, and spring means for biasing said gates toward said initial positions; means acting continuously above the level of liquid coating material in said chamber to produce a pressure differential between the interior and exterior of said chamber sufficient to induce a continuous flow of air into said chamber about the periphery of portions of material positioned within said entrance and exit ports and upwardly through said liquid coating material in said chamber, said flow of air serving to seal said ports, to remove excess amounts of said coating material on surface portions of said units exiting said chamber, and at least partly to dry said coating on said exiting surface portions of said units; and a dimension sensing element, second mounting means for mounting said dimension sensing element inside said chamber in position-communicating-relation with said slidably mounted vertical gate at said outlet aperture, and including element positioning means for setting an initial position of said dimension sensing element a short distance above the top surface of a unit of material of normal dimension extending through said chamber, said dimension sensing element being adapted to contact the leading end of a unit of material having a thickness greater than said normal dimension and thereupon automatically to adjust the position of said slidably mounted vertical gate at said outlet aperture to maintain a small air gap between the bottom edge of said gate and the top surface of said unit of material passing through said exit port, whereby the integrity of the coating material on said associated surface is maintained.

8. Apparatus as claimed in claim 7, wherein all of said slidably mounted gates at said inlet aperture and said pair of horizontal gates at said outlet aperture each have one bevelled edge adapted to contact portions of material passing through an associated port and having at least one dimension larger than normal to enable said portions of material to adjust the position of one or more of said gates to enlarge the size of the associated port to correspond to said larger dimension of said portion.

9. Apparatus as claimed in claim 8, wherein each of said slidably mounted vertical gates is generally rectangular with a width generally corresponding to the width of said apertures and a height at least greater than the height of said apertures and each of said horizontal gates is generally rectangular with a height generally corresponding to the height of said apertures and a width at least greater than one-half the width of said apertures; said mounting means comprises a mounting frame having a top spacer bar mounted to said chamber above said associated aperture, a bottom spacer bar mounted along with said fixed bottom gate to said chamber below said associated aperture, and a pair of gate retaining bars mounted to said spacer bars at the sides of said associated aperture and having an inwardly extending front lip, said spacer bars and said retaining bars forming a channel at each side of said aperture for receiving and retaining said horizontal gates in sliding relation with the side edges of said aperture, said front lips of said retaining bars and said top spacer bar forming a channel for receiving and retaining said top vertical gate in sliding relation with the top edge of said aperture; the front wall of said coating chamber and the top spacer bar mounted on said front wall having coincident slots therethrough, said top vertical gate at said exit port having at least one position adjustment housing thereon and slot in the rear wall thereof communicating between said housing and said slots in said chamber wall and top spacer bar; said second mounting means comprises a mounting frame having at least one arm extending through said slots in said chamber, said top spacer bar and said position adjustment housing and normally resting on the bottom of said slot in said coating chamber wall; said positioning means for said vertical gate at said exit port comprising at least one position adjusting bolt received in a threaded aperture at the top of said position adjustment housing, the bottom end of said position adjusting bolt being adapted to contact an end portion of said mounting frame arm extending into said position adjustment housing whereby said position adjusting bolt may be utilized to adjust the initial vertical position of the bottom edge of said top vertical gate and said dimension sensing element and said top vertical gate will be raised up together by the leading edge of a unit of strip material having a thickness greater than normal.

10. Apparatus as claimed in claim 9, wherein said mounting frame extends from the back to front walls of said chamber and is pivotally mounted at the rear wall of said chamber; said dimension sensing element comprises a generally rectangular bar extending transverse to said mounting frame and said element positioning means comprises telescoping columns including an outer column mounted to said mounting frame and an inner column mounted to said dimension sensing element and adjusting means for adjusting the vertical position of said inner column with respect to said outer column.

11. Apparatus as claimed in claim 10, wherein the front wall of said coating chamber and the top spacer bar mounted on said front wall have a pair of coincident slots extending therethrough; said top vertical gate at said exit port has a pair of position adjustment housings each having a slot in the rear wall thereof communicating with one of said pair of said slots in said chamber wall and top spacer bar; said mounting frame comprises a U-shaped frame having a pair of arms each extending through one of said pair of slots in said chamber, said top spacer bar and said position adjustment housings; said element positioning means comprises a pair of telescoping column arrangements each mounted on one leg of said U-shaped frame; and said dimension sensing element further comprises a second rectangular bar forming with said first rectangular bar a T-shaped dimension sensing element with the foot of said second rectangular bar being adapted to initially contact an oversize unit of material entering said coating chamber for leading the leading edge of said oversize unit of material into said first rectangular bar and thereupon causing said U-shaped frame to pivot upward and raise said top vertical gate.

12. Apparatus as claimed in claim 11, further comprising a side guide arrangement comprising a pair of side guide brackets slidably mounted on said U-shaped mounting frame and having a pair of vertical walls extending parallel to and below the legs of said U-shaped frame and positioning means for setting the positions of said guide walls in near proximity to the sides of a unit of material passing through said chamber.

13. Apparatus as claimed in claim 7, wherein said guide means consists of a masking element extending between said inlet and outlet apertures, one surface of said masking element being configured to form a pocket adjacent a preselected portion of at least one surface of units of material passing through said chamber, said masking element thereby causing a stream of air from the exterior of said chamber to pass continuously over said preselected surface portion of said units to preclude application of said coating material thereon.

14. In a system for continuous application of a liquid coating material onto the surfaces of successive units of material having varying cross-sectional dimensions, a coating chamber substantially closed to the atmosphere for containing a substantial head of liquid coating material, said coating chamber defining rectangular inlet and outlet apertures therein generally conforming to the dimensions of the largest cross-section of material to be coated in said chamber, said apertures being located on opposite sides of said chamber in substantial horizontal alignment with each other and at a level in said chamber where substantial hydrostatic pressure of said liquid coating material will be maintained; guide means mounted in said coating chamber between said inlet and outlet apertures and adapted to contact the bottom of each unit of material passing through said chamber bottom surface of exiting portions of said material a small distance above the bottom edge of said outlet aperture; port defining means mounted over each of said inlet and outlet apertures for providing entrance and exit ports of adjustable dimensions, each of said port defining means comprising a pair of vertical gates and a pair of horizontal gates, mounting means for mounting the bottom one of said vertical gates in a fixed position with a top edge aligned with the bottom edge of an associated aperture and for mounting each of said other gates in sliding relation with a different one of the other edges of said associated aperture, positioning means for setting an initial position of each of said other gates to establish initial minimum dimensions of the exit port slightly larger than cross-sectional dimensions of units of material to be coated and initial minimum dimensions of the entrance port equal to the cross-sectional dimensions of said material, and spring means for biasing said gates toward said initial positions; means acting continuously above the level of liquid coating material in said chamber to produce a pressure differential between the interior and exterior of said chamber sufficient to induce a continuous flow of air into said chamber about the periphery of portions of material positioned within said entrance and exit ports and upwardly through said liquid coating material in said chamber, said flow of air serving to seal said ports, to remove excess amounts of said coating material on surface portions of said units exiting said chamber, and at least partly to dry said coating on said exiting surface portions of said units; each of said slidably mounted vertical gates being generally rectangular with a width generally corresponding to the width of said apertures and a height at least greater than the height of said apertures; each of said horizontal gates being generally rectangular with a height generally corresponding to the height of said apertures and a width at least greater than one-half the width of said apertures; and said mounting means comprising a mounting frame having a top spacer bar mounted to said chamber above said associated aperture, a bottom spacer bar mounted along with said fixed bottom gate to said chamber below said associated aperture, and a pair of vertical gate retaining bars mounted to said spacer bars at the sides of said associated aperture and having an inwardly extending front lip, said spacer bars and said retaining bars forming a channel at each side of said aperture for receiving and retaining said horizontal gates in sliding relation with the side edges of said aperture, and said front lips of said retaining bars and said top spacer bar forming a channel for receiving and retaining said top vertical gate in sliding relation with the top edge of said aperture.

15. Apparatus as claimed in claim 14, wherein said positioning means for said slidably mounted vertical gates comprises a pair of horizontally disposed ears carried on the top surface of said vertical gate and extending over said gate retaining bars, said ears having a threaded aperture therein and receiving a bolt having a bottom surface adapted to contact the top of one of said gate retaining bars; and said positioning means for said horizontal gates comprises a gate bracket fixed to the outside edge of said gate and having one wall extending transverse to said gate with an aperture therethrough, a bushing mounted in said aperture, a slide rod bracket fixed to said chamber and having an aperture therethrough in horizontal alignment with said aperture in said gate bracket, a slide rod extending through said apertures, stop means carried on said slide rod for fixing a maximum inward position of said gate bracket on said slide rod and fastener means associated with said slide rod bracket for fixing the initial position of said stop means.

16. Apparatus as claimed in claim 15, wherein said spring means associated with said vertical gate comprises a pair of tension springs, one end of said tension springs being hooked to one of a pair of hooking elements carried on said gate and the other end of said springs being hooked to one of a pair of hooking elements carried on said chamber; and said spring means associated with each of said horizontal gates comprises a compression spring carried on said slide rod outside said slide bracket and second stop means on the outward end of said slide rod for confining said compression spring on said rod.

17. In a system for continuous application of a liquid coating material onto surfaces of successive units of material, a coating chamber substantially closed to the atmosphere for containing a substantial head of liquid coating material, port defining means for providing entrance and exit ports in said coating chamber having configurations generally corresponding to the cross-sectional configuration of units of material to be coated in said chamber and located at a level in said chamber where substantial hydrostatic pressure of said liquid coating material will be maintained; and a masking element mounted within said chamber and extending between said entrance and exit ports, said masking element being configured to form a pocket adjacent a preselected portion of at least one surface of units of material passing through said chamber; and means acting continuously above the level of liquid coating material in said chamber to produce a pressure differential between the interior and exterior of said chamber sufficient to induce a continuous flow of air into said chamber about the periphery of portions of material positioned within said entrance and exit ports and across said preselected surface portion of said units and thence upwardly through said liquid coating material in said chamber, said flow of air serving to seal said ports, to remove excess amounts of said coating material on surface portions of said units exiting said chamber, at least partly to dry said coating on said exiting surface portions of said units, and to preclude application of said coating material on said preselected surface portion of said units.

18. Apparatus as claimed in claim 17, wherein said masking element is mounted underneath said exit and entrance ports to serve as both a guide means and a masking element for units of material passing through said chamber.

19. In a system for continuous application of a liquid coating material onto the surfaces of successive units of material having varying cross-sectional dimensions, a coating chamber substantially closed to the atmosphere for containing a substantial head of liquid coating material, said coating chamber defining an inlet aperture and an outlet aperture therein generally conforming to the dimensions of the largest cross section of material to be coated in said chamber, said apertures being located on opposite sides of said chamber in substantial alignment with each other and at a level in said chamber where substantial hydrostatic pressure of said liquid coating material will be maintained; port defining means mounted over each of said inlet and outlet apertures for providing entrance and exit ports of adjustable dimensions, each of said port defining means comprising at least one gate, gate mounting means for mounting said gate in sliding relation with one of the edges of an associated aperture, positioning means for setting an initial position of said gate, and spring means for biasing said gate toward said initial position; means acting continuously above the level of liquid coating material in said chamber to produce a pressure differential between the interior and exterior of said chamber sufficient to induce a continuous flow of air into said chamber about the periphery of portions of material positioned within said entrance and exit ports and upwardly through said liquid coating material in said chamber; and a masking element mounted within said chamber and extending between said entrance and exit ports, said masking element being configured to form a pocket adjacent a preselected portion of at least one surface of units of material passing through said chamber, said pocket communicating with said entrance and exit ports such that a continuous flow of air passes through said pocket and across said preselected surface portion of units of material to preclude application of said liquid coating material on said preselected surface portions.

20. Apparatus as claimed in claim 19, wherein said masking element is mounted underneath said entrance and exit ports and serves as both a guide means and a masking element for units of material passing through said chamber.

* * * * *